United States Patent [19]

Millen

[11] Patent Number: 5,042,159

[45] Date of Patent: Aug. 27, 1991

[54] CHALK LINE RETRACTION DEVICE

[76] Inventor: Leo Millen, 3469 McNab Ave., Long Beach, Calif. 90808

[21] Appl. No.: 441,943

[22] Filed: Nov. 27, 1989

[51] Int. Cl.[5] ..... B44D 3/38

[52] U.S. Cl. ..... 33/414; 33/756

[58] Field of Search ..... 33/414, 413, 756, 761, 33/769

[56] References Cited

U.S. PATENT DOCUMENTS

| | | | |
|---|---|---|---|
| 70,022 | 10/1867 | Richel | 33/414 |
| 88,212 | 3/1869 | Richardson | 33/414 |
| 627,057 | 6/1899 | Gavin | 33/414 |
| 648,044 | 4/1900 | Miller | 33/414 |
| 754,827 | 3/1904 | Thompson . | |
| 1,168,851 | 1/1916 | Carter | 33/414 |
| 1,208,068 | 12/1916 | Winchell | 33/414 |
| 1,272,270 | 7/1918 | Jarvio | 33/414 |
| 2,589,500 | 3/1952 | Landon et al. . | |
| 2,655,728 | 10/1953 | Cook | 33/414 |
| 3,888,010 | 6/1975 | Hyde et al. . | |
| 4,192,078 | 3/1980 | Lore et al. | 33/414 |
| 4,197,656 | 4/1980 | Lane et al. | 33/414 |
| 4,438,538 | 3/1984 | Larsen . | |
| 4,565,011 | 1/1986 | Karger | 33/414 |
| 4,592,148 | 6/1986 | Longette | 33/414 |
| 4,600,291 | 4/1987 | Dehn . | |

FOREIGN PATENT DOCUMENTS

| | | | |
|---|---|---|---|
| 140646 | 5/1902 | Fed. Rep. of Germany | 33/414 |

*Primary Examiner*—Thomas B. Will

*Attorney, Agent, or Firm*—Charles H. Thomas

[57] ABSTRACT

A chalk line retraction device is formed of a hollow casing defining a chalk line aperture therethrough. A chalk line reel carrying a chalk line is mounted for rotation within the casing and is keyed to a spur gear. The spur gear is engaged with a ring gear of much larger pitch diameter. The ring gear is coupled to a movable end of a spirally wound band spring. The other end of the band spring is anchored to the casing. The gearing arrangement provides a mechanical advantage such that a relatively long movement of the chalk line produces a corresponding short movement of the movable end of the band spring, thereby allowing a chalk line of considerable length to be taken up on the chalk line reel.

6 Claims, 2 Drawing Sheets

CHALK LINE RETRACTION DEVICE

BACKGROUND OF THE INVENTION

1. Field of the Invention

The present invention is directed to a chalk line retraction device which employs a spirally wound band spring coupled to a chalk line reel at a mechanical advantage.

2. Description of the Prior Art

Chalk lines are widely used during building construction for marking lines on floors, walls and the like where cuts are to be made or where cabinets, shelves and other built-in furnishings are to be installed. A chalk line is wound on a reel or spool and coated with dry chalk. The free end of the chalk line is held at a predetermined location and the chalk line is stretched to the opposite end of a line to be marked. The ends of the chalk line are placed against the surface to be marked and the length of the chalk line therebetween is stretched taut. The center of the chalk line is then drawn outwardly from that surface and released. The resiliency of the chalk line causes the line to rebound against the surface to be marked, thereby causing a linear chalk marking to be formed upon a wall or floor. Markings of this type facilitate the making of straight cuts and the installation of lengthy furnishings.

Various different chalk line retraction device have been constructed to aid in winding a chalk line on a reel or drum. One prior automated retractable chalk line assembly is described in U.S. Pat. No. 4,565,011. This device employs a chalk line mounted on a spool which is coupled through gearing to a wire, coil spring. However, the device of that assembly is capable of automatically retracting a chalk line of only a very short length, since the ends of the coil spring can only undergo very limited angular rotational displacement relative to each other.

In the system of U.S. Pat. No. 4,565,011 a long length of chalk line will be only partially retracted before the spring is totally relaxed and must be retensioned to aid in retracting any more of the chalk line. Thus, to fully retract a long length of chalk line it is necessary to repeatedly rewind the spring with the chalk line locked, then release the chalk line lock so that an additional portion of the unwound chalk line can be retrieved. Such an arrangement is quite inefficient, since it requires the user to manually retension the spring in a repeated series of steps to fully retract a long length of chalk line.

SUMMARY OF THE INVENTION

The present invention provides a chalk line retraction device which is completely automatic, and which does not require manual retensioning of a spring even to rewind very long lengths of chalk line, such as lengths of fifty or one hundred feet. Unlike the chalk line retraction device of U.S. Pat. No. 4,565,011, the chalk line retraction device of the present invention does not employ a wire spring coiled in the shape of a tubular spiral having ends longitudinally offset from each other and located equidistant from an axial center. To the contrary, the chalk line retraction device of the present invention employs a spiral band spring which lies essentially in a single plane in a disk-shaped volume and in which the ends are radially displaced from each other, not longitudinally displaced relative to the axial center of winding. Such a spirally wound band spring or leaf spring can be formed in a very considerable length and will still occupy only a very small volume. A spiral band spring of this type will be increasingly tensioned by the withdrawal of a great length of chalk line, and thus will fully retract very long lengths of chalk line which have been withdrawn from the casing.

A further feature of the chalk line retraction device of the invention is the provision of a gearing system rotatably mounted within the chalk line casing and which is coupled to the movable end of the band spring and to the chalk line reel with a mechanical advantage, whereby a distance of movement of the chalk line through the chalk line aperture is transformed to a much smaller distance of movement of the movable end of the band spring within the casing. Preferably, the ratio of movement of the chalk line to resilient displacement of the movable end of the band spring is at least three to one, and the ratio of angular rotation of the chalk line reel to angular rotation of the movable end of the band spring preferably is about 3.5:1.

An important object of the invention is to provide a chalk line retraction device in which considerable lengths of chalk line, from fifty to one hundred feet, can be withdrawn from the casing of the retraction device while continually increasing tension on the spring. Each incremental portion of the chalk line which is withdrawn produces a corresponding incremental resilient deformation of the band spring throughout the withdrawal of the entire length of the chalk line. Thus, when retraction of the chalk line is desired, the resiliently tensioned band spring will completely retract the entire length of chalk line, all at once, contrary to prior systems, such as that of U.S. Pat. No. 4,565,011.

A further object of the invention is to provide a chalk line retraction device of extremely compact design Preferably, the gearing employed includes an externally toothed spur gear keyed to a chalk line reel and arranged in meshed engagement with a considerably larger ring gear and which is coupled to the movable end of the band spring which encircles the spur gear. By employing a spur gear of a thickness no greater than the width of the teeth of the ring gear, the spur gear can be completely encompassed within the volume occupied by the ring gear, thus reducing the required size of the casing. The required volume occupied by the casing is further reduced by employing a spirally wound band spring having radial inner and radial outer ends. A band spring of considerable length can thereby be housed within a relatively small disk-shaped volume.

In one broad aspect the present invention is a chalk line retraction device comprising a hollow casing defining a chalk line aperture therein, a chalk line reel mounted for rotation within the casing, a chalk line emanating from the casing through the chalk line aperture and having one end secured to the chalk line reel, a helical band spring having radial inner and outer ends, one of which is movable within the casing and the other of which is anchored to the casing, and gearing means rotatably mounted within the casing and coupling the movable end of the band spring to the reel at a mechanical advantage, whereby a distance of movement of the chalk line through the chalk line aperture is transformed to a smaller distance of movement of the end of the band spring that is movable within the casing.

Preferably, the gearing means reduces the angular movement of the chalk line reel to angular movement of the movable end of the band spring by a ratio of at least three to one. The gearing means is preferably comprised of a spur gear keyed for rotation with the chalk line reel, and a ring gear having a pitch diameter at least three times as great as that of the spur gear and coupled to the movable end of the band spring. In the preferred embodiment the outer end of the band spring is anchored to the housing and the inner end of the band spring is the movable end. The ring gear shaft is keyed to both the ring gear and to the inner end of the band spring.

The invention may be described with greater clarity and particularity with reference to the accompanying drawings.

DESCRIPTION OF THE EMBODIMENT

Figure 1:
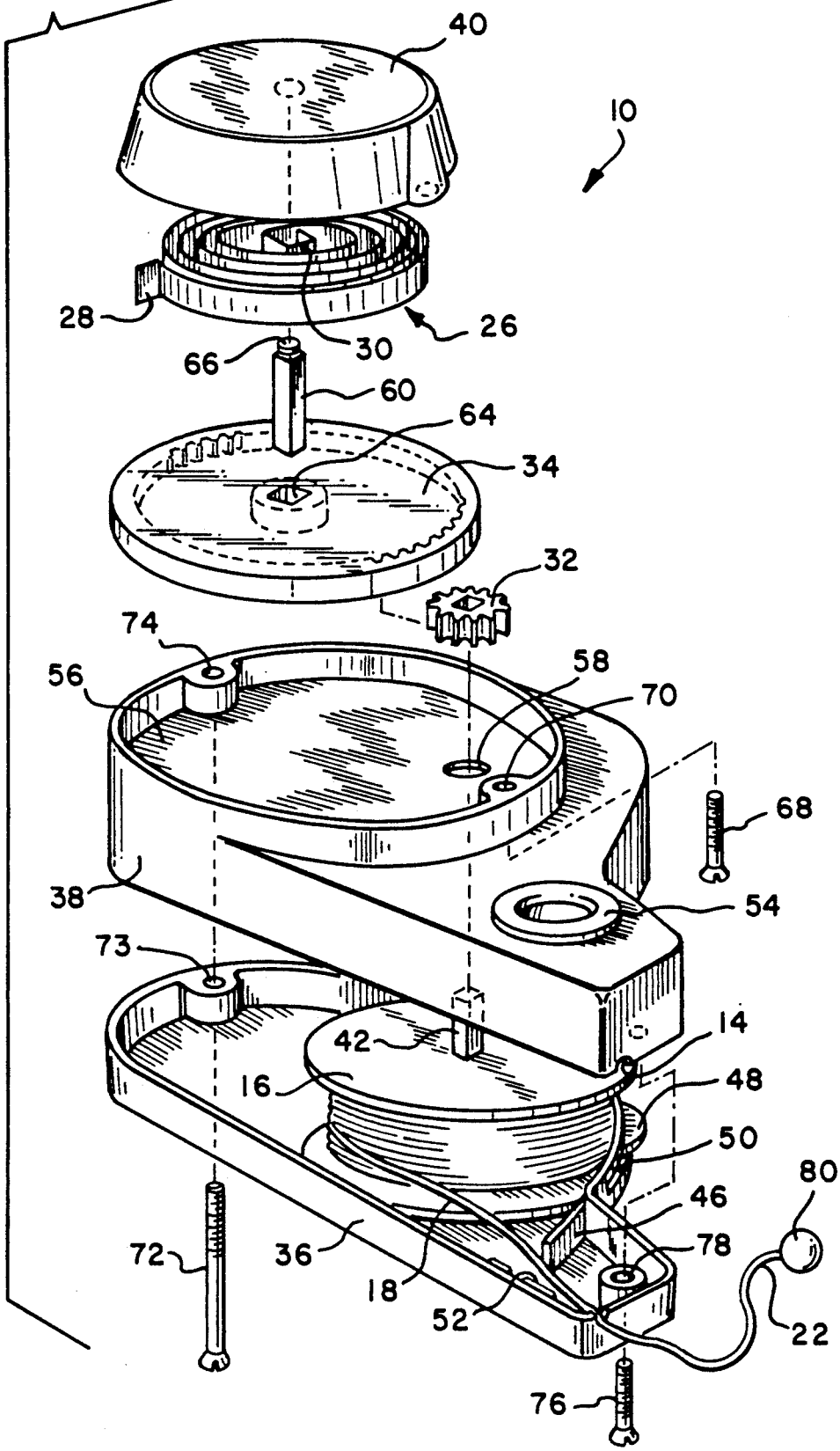
FIG. 1 is an exploded perspective view of a preferred embodiment of the chalk line retraction device of the invention.
Figure 2:
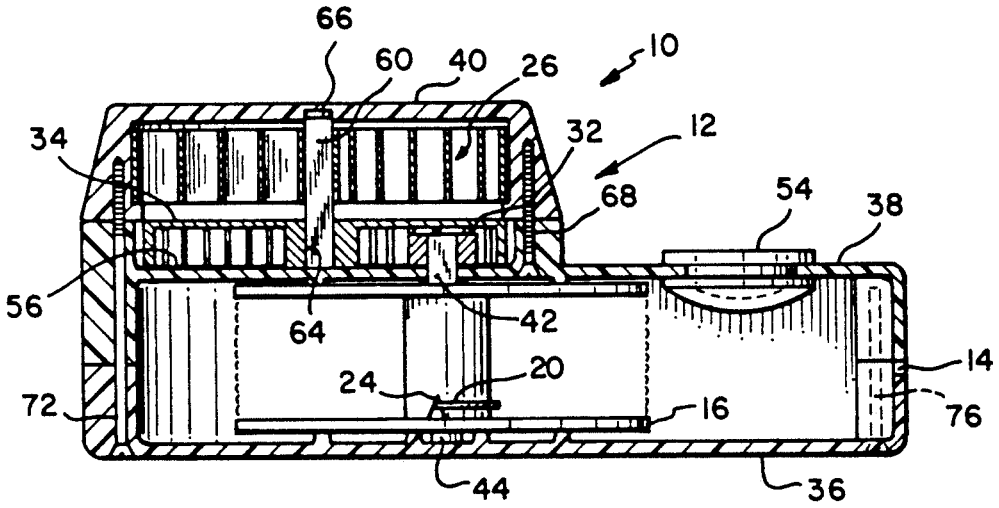
FIG. 2 is a sectional elevational view of the chalk line retraction device of FIG. 1.

FIG. 1 illustrates a chalk line retraction device 10 comprised of a hollow casing indicated generally at 12 in which a chalk line aperture 14 is formed. A chalk line winding drum or reel 16 is mounted for rotation within the casing 12. A flexible chalk line 18 has opposite ends 20 and 22. The end 20 is secured to the hub of the drum 16 by frictional engagement in a V-shaped crevice 24 therein, as depicted in FIG. 2. The other end 22 of the chalk line 18 emanates from the casing 12 through the chalk line aperture 14.

A spiral band spring 26 has a radially outer fixed end 28 anchored to the cap 40 and an opposite movable radially inner end 30 coupled to move with rotation of the winding drum 16. Gears 32 and 34 couple the winding drum 16 to the band spring 26 such that the ratio of distance of movement of the chalk line 18 on the winding drum 16 to the distance of movement of the movable end 30 of the band spring 26 within the cap 40 is greater than unity. Preferably the ratio of angular movement of the chalk line drum 16 to that of the movable end 30 of the band spring 26 is at least three to one.

The casing 12 is formed of a pair of tray-shaped shell sections 36 and 38 which fit together to form a winding drum and chalk line cavity. The casing 12 also includes a hollow frusto-conical cap 40 which fits on top of the shell section 38 to define an enclosure for the band spring 26 and the gears 32 and 34. The space between the shell sections 36 and 38 is adapted to receive the winding drum or chalk line reel 16, upon which the chalk line 18 is wound, and also powdered chalk adjacent the aperture 14.

The winding drum 16 is formed with a hub or spool having axially separated disk-shaped side retainers to laterally confine the chalk string 18 therebetween. At its axial center the hub of the winding drum 16 is formed with an axial aperture of square cross section adapted to receive the central, square portion of a drum mounting shaft 42 in keyed engagement therewith. One end of the drum mounting shaft 42 is formed with a cylindrical stub axle 44 which is captured within a concave circular axle seat defined in the interior wall of the shell section 36, while the opposite square end of the drum mounting shaft 42 extends through an opening 58 in the wall of the shell section 38.

A slide switch 46 having a thumb operated slide actuator 48 is mounted against the inside wall of the shell section 36 by means of tracks formed on the inside of the shell section wall such that the slide 46 is captured and held in an arcuate slide switch slot 50 of uniform width throughout in the wall of the shell section 36. The slide switch actuator 48 protrudes externally from the casing 12.

Figure 3:
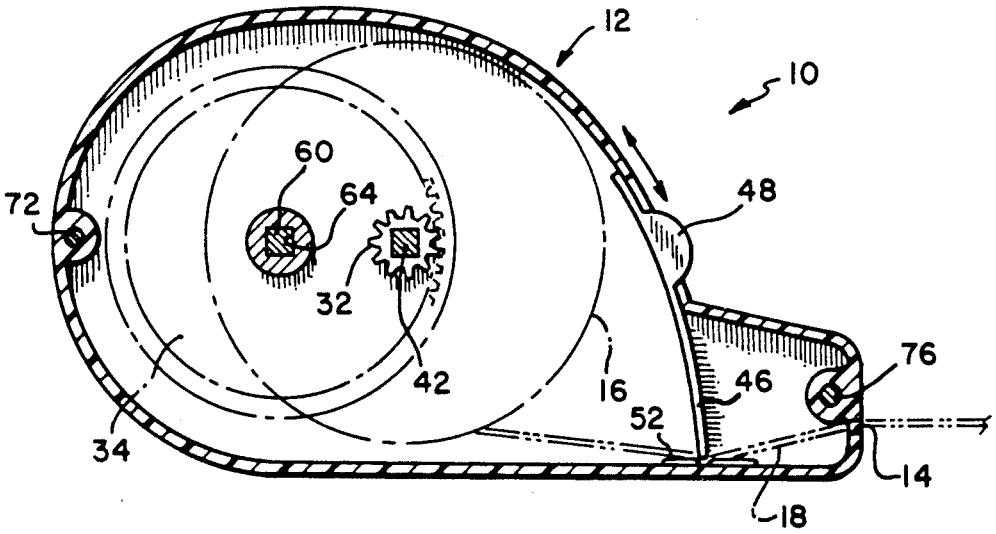
FIG. 3 is a sectional plan view of the chalk line retraction device of FIG. 1.

As best illustrated in FIG. 3, the slide switch 46 may be moved in an arcuate path by downward force on the switch actuator 48 to clamp the chalk line 18 against a rubber stop 52 that is secured to the inner surface of the wall of the shell 36. When the slide switch 46 is moved to the chalk line clamping position as depicted in FIG. 3, it engages a detent (not shown). The chalk line 18 is thereupon locked immobile relative to the shell 12, despite the retracting force exerted by the band spring 26. When the slide switch actuator 48 is moved upwardly to another detent, drawing the slide 46 away from the rubber stop 52, the tension in the band spring 26 will cause the winding drum 16 to rotate and retract the chalk line 18 onto the winding drum spool. This force of retraction is exerted regardless of the length of the chalk line 18 that extends externally of the housing 12 through the chalk line aperture 14.

The wall of the shell section 38 has a circular opening in which a rubber chalk gate 54 is positioned. Additional chalk can be introduced into the cavity defined between the shell sections 36 and 38 through the rubber chalk gate 54 to maintain a sufficient amount of chalk on the chalk line 18. The chalk line 18 picks up chalk introduced through the rubber gate 54 and stored in the winding drum and chalk line cavity as it is withdrawn through the chalk line aperture 14.

The shell section 38 and the cap 40 together define a shallow gear and spring cavity 56 on the side of the shell section 38 opposite the winding drum 16. The square shaft 42 upon which the winding drum 16 is mounted extends into the gear and spring cavity 56 through an opening 58 in the wall of the shell 38. A small spur gear 32 having an axial aperture therethrough of square cross section is keyed to the end of the square shaft 42 and resides within the gear and spring cavity 56. The spur gear 32 serves as a chalk line reel gear and is keyed to the chalk line reel or drum 16. The spur gear 32 thereby is locked to turn in rotation with the winding drum 16. The spur gear 32 undergoes one complete revolution with each revolution of the chalk line winding drum 16.

The spiral band spring 26 is formed as an elongated leaf spring constructed of spring steel, preferably between about one half and three quarters of an inch in width. The band spring 26 is wound in a helical spiral, progressing from the radial inner end 30 to the radial outer end 28. The radial inner and outer ends 30 and 28 are radially displaced from each other, but lie in a coplanar relationship.

The radially inner end 30 of the spiral band spring 26 is inelastically deformed into a generally U-shaped configuration so as to be seated on the square shank of the connecting rod 60. The radial inner end 30 of the spiral band spring 26 is thereby locked in keyed engagement with the shank of the connecting rod 60. The lower square end of the connecting rod 60 fits snugly into the square axial opening 64 at the center of the ring gear 34. The upper end 66 of the connecting shaft 60 is of circular cross section and seats within an annular ring defined in the underside of the cap 40 of the housing 12. The movable end 30 of the spiral band spring 26 and the ring gear 34 are thereby keyed to rotate together about one axis, while the spur gear 32 and the chalk line winding drum 16 are keyed to rotate together about a parallel axis.

The external teeth of the spur gear 32 reside in meshed engagement with the internal teeth of the ring gear 34. The ring gear 34 completely encircles the spur gear 32. The width of the teeth of the spur gear 32 is slightly less than the width of the ring gear 34, so that the spur gear 32 is totally enclosed within the cavity defined between the underside of the ring gear 34 and the floor of the gear and spring cavity 56.

The radially outer, fixed end 28 of the band spring 26 extends laterally into a radially oriented slot defined in the interior wall of the cap 40. A screw 68 extends through an opening 70 in the shell section 38 and up into a tapped opening in the cap 40. Another screw 72 extends through openings 73 and 74 in the shell sections 36 and 38 and is engaged in a tapped opening in the cap 40, as depicted in FIGS. 1 and 2. The gears 32 and 34 and the spiral band spring 26 are thereby confined within the gear and spring cavity 56 between the cap 40 and the shell section 38. Another screw 76 extends through an opening 78 in the shell section 36 and into a tapped well in the shell section 38, thereby enclosing the chalk line winding drum 16 in the cavity between the shell sections 36 and 38. The screws 68, 72 and 76 thereby hold the entire casing or housing 12 together.

At least the interior end 20 of the chalk line 18 is secured to the hub of the chalk line winding drum 16. The externally protruding end 22 of the chalk line 18 is provided with a hook 80 that will not pass through the chalk line aperture 14.

To utilize the chalk line retraction device 10, a length of the chalk line 18 is pulled from the chalk line aperture 14. Any portion or the entire length of chalk line 18 may be pulled through the aperture 14, with the exception of the end 20 which is secured to the spool of the winding drum 16.

As the chalk line 18 is pulled from the housing 12, the winding drum 16 is rotated counterclockwise, as viewed in FIGS. 1 and 3, thereby rotating the spur gear 32 counterclockwise as well. The spur gear 32 in turn rotates the ring gear 34 also in a counter-clockwise direction, but at a greatly reduced radial distance. Preferably, the pitch diameter of the ring gear 34 to that of the spur gear 32 is 3.5:1. Therefore, for every 3.5 inches of chalk line 18 that are pulled through the chalk line aperture 14, the movable end 30 of the spiral band spring 26 will move considerably less than one inch in a circular path of rotation about the axis of the shaft 60, since the diameter of the chalk line spool of the winding drum 16 is considerably greater than the width of the connecting rod 60. Because the radial outer end 28 of the band spring 26 is anchored to the cap 40 the spiral band spring 26 will be placed under increasing tension as the chalk line 18 is pulled out of the casing 12.

Once the requisite length of chalk line 18 has been extracted from the housing 12, the slide switch 46 is actuated by clamping the slide actuator 48 downwardly, so that the chalk line 18 is immobilized relative to the rubber stop 52. The chalk line 18 can then be used to mark a straight line by pulling the extracted length of chalk line 18 taut and snapping the chalk line 18 against the surface to be marked.

To retract the chalk line 18, the slide actuator 48 is moved upwardly, thereby releasing the chalk line 18 from the clamped position against the rubber block 52. The band spring 26 therefore unwinds to release its tension. That is, the movable end 30 of the band spring 26 travels in a circular arcuate path in a clockwise direction, as viewed in FIG. 1. This clockwise rotation of the movable end 30 of the band spring 26 is transmitted to the connecting rod 60, which turn rotates the ring gear 34 in a clockwise direction as well. The ring gear 34 in turn rotates the spur gear 32 in a clockwise direction at a mechanical advantage. That is, for every rotation of the ring gear 34, the spur gear 32 will undergo 3.5 revolutions.

A spirally wound band spring of the type depicted at 26 in the drawings can have a much greater length than a coil spring which occupies the same volume. Consequently, even when fifty to one hundred feet of chalk line 18 are pulled from the housing 12, the band spring 26 will continually be placed under increased tension for each increment of chalk line that is withdrawn to thereby exert a corresponding retraction force. There is no slippage or clutch mechanism in the chalk line retraction device 10 so that the increased tension in the band spring 26 will entirely retract the chalk line 18 onto the chalk line drum 16 for storage.

Undoubtedly, numerous variations and modifications of the invention will become evident to those familiar with chalk line retraction devices. For example, different gearing arrangements may be employed in place of the meshed spur gear and ring gear arrangement of the embodiment described. Accordingly, the scope of the invention should not be construed as limited to the specific embodiment illustrated and described, but rather is defined in the claims appended hereto.

I claim:

1. A chalk line retraction device comprising:

a hollow casing defining a chalk line aperture therein, and comprised of a pair of tray-shaped shell sections which are completely separable from each other and which fit and are securable together to form an enclosed chalk cavity bounded on opposite sides by walls of said shell sections, one of which has an opening therethrough and the other of which has an axle seat directly opposite said opening, a chalk line reel having a mounting shaft on one side and a stub axle on the other and mounted for rotation within said chalk cavity, with said mounting shaft extending through said opening in said wall of said one shell section and with said stub axle rotatably seated in said axle seat of said other shell section, a chalk line at least fifty feet in length emanating from said casing through said chalk line aperture and having one end secured to said chalk line reel, a cap mounted against a wall of a said one shell section on a side thereof opposite said other shell section so as to define a gear and spring enclosure and so as to encompass said opening in said wall of said one shell section and wherein said cap is completely removable from said on shell section, a helical band spring located within said spring enclosure and having radial inner and outer ends, one of which is movable within said gear and spring enclosure and the other of which is anchored relative to said casing, and gearing means rotatably mounted within said gear and spring enclosure and coupling said movable end of said band spring to said reel and including a spur gear keyed for rotation with said chalk line reel, and a ring gear having teeth that surround said opening and said spur gear and extend toward said wall of said one of said shells, and said ring gear has a pitch diameter at least three times as great as that of said spur gear whereby a distance of movement of said chalk line through said chalk line aperture is transformed to a smaller distance of movement of said end of said band spring that is movable within said casing.

2. A chalk line retraction device according to claim 1 wherein said outer end of said band spring is anchored to said casing, and said inner end of said band spring is said movable end, and further comprising a ring gear shaft keyed to both said ring gear and to said inner end of said band spring.

3. A chalk line retraction device according to claim 2 wherein the ratio of said pitch diameter of said ring gear to that of said spur gear is 3.5:1.

4. A chalk line retraction device comprising:

a hollow casing in which a chalk line aperture is formed comprised of a pair of tray-shaped shell sections which are completely separable form each other and which fit and are securable together to form an enclosed chalk cavity bounded on opposite sides by walls of said shell sections, one of which has an opening therethrough and the other of which has an axle seat directly opposite said opening, a chalk line winding drum mounted for rotation within said chalk cavity, by a stub axle captured by said axle seat and having a shaft coaxial with said stub axle that extends through said opening.

a flexible line at least fifty feet in length having opposite ends, one of which is secured to said winding drum and the other of which emanates from said chalk cavity through said chalk line aperture, a cap mounted against a wall of said one shell section on a side thereof opposite said other shell section so as to define a gear and spring enclosure and so as to encompass said opening in said wall of said one shell section and wherein said cap is completely removable from said one shell section, a spiral band spring located within said gear and spring enclosure and having a fixed end anchored relative to said casing and an opposite movable end coupled to move with rotation of said winding drum, and gear means having an externally toothed gear keyed to said winding drum, and an internally toothed gear having a pitch diameter at least three times that of said externally toothed gear coupled to said movable end of said band spring and encircling said externally toothed gear in meshed engagement therewith, thereby coupling said winding drum to said movable end of the band spring such that the ratio of distance of movement of said chalk line on said winding drum to the distance of movement of said movable end of said band spring within said spring enclosure is at least three to one.

5. A chalk line retraction device according to claim 4 wherein said movable end of said spiral band spring is a radially inner end and said fixed end of said spiral band spring is a radially outer end.

6. A chalk line retraction device comprising:

a hollow casing defining a chalk line aperture therethrough, and comprised of a pair of tray-shaped shell sections which are completely separable from each other and which fit and are securable together to form an enclosed chalk cavity bounded on opposite sides by walls of said shell sections, one of which has an opening therethrough and the other of which has an axle seat directly opposite said opening, a chalk line reel having a chalk line secured thereto for winding thereon and having a stub axle seated in said axle seat and a mounting shaft extending through said opening wherein said chalk line reel is mounted for rotation within said cavity, a chalk line at least fifty feet in length having a first end secured to said chalk line reel and a second end that emanates from said casing through said chalk line aperture, a cap mounted against a wall of said one shell section on a side thereof opposite said other shell section so as to define a gear and spring enclosure and so as to encompass said opening in said wall of said one shell section and wherein said cap is completely removable from said one shell section, a chalk line reel gear comprised of a spur gear mounted on said mounting shaft and located within said gear and spring enclosure to rotate with said chalk line reel, a spiral band spring disposed in said gear and spring enclosure and having opposite radial inner and radial outer ends, one of which is anchored relative to said casing, and a spring gear comprising a ring gear mounted for rotation within said gear and spring enclosure and in meshed engagement with said chalk line reel gear wherein said spring gear has a pitch diameter at least three times that of said chalk line reel gear, and wherein the other of said ends of said spring band spring is coupled to said spring gear.

* * * * *